United States Patent [19]

Knapp

[11] Patent Number: 4,966,514

[45] Date of Patent: Oct. 30, 1990

[54] CONTAINER DUMPING MECHANISM

[76] Inventor: Johnn P. Knapp, 156 Las Colinas, Corralitos, Calif. 95076

[21] Appl. No.: 341,438

[22] Filed: Apr. 20, 1989

[51] Int. Cl.[5] ..... B65F 3/02

[52] U.S. Cl. ..... 414/408; 414/421

[58] Field of Search ..... 414/404, 406, 408, 409, 414/419, 420, 421

[56] References Cited

U.S. PATENT DOCUMENTS

| | | | |
|---|---|---|---|
| 3,738,516 | 6/1973 | Wells | 214/302 |
| 3,804,277 | 4/1974 | Brown et al. | 214/302 |
| 4,042,137 | 8/1977 | Hughes et al. | 214/302 |
| 4,365,922 | 12/1982 | Borders | 414/406 |
| 4,422,814 | 12/1983 | Borders | 414/303 |
| 4,479,751 | 10/1984 | Wyman et al. | 414/406 |
| 4,673,327 | 6/1987 | Knapp | 414/408 |

FOREIGN PATENT DOCUMENTS

| | | | |
|---|---|---|---|
| 2758583 | 7/1979 | Fed. Rep. of Germany | 414/408 |
| 21515929 | 12/1985 | Fed. Rep. of Germany | 414/408 |
| 2479783 | 10/1981 | France . | |
| 2500425 | 8/1982 | France . | |
| 8501396 | 12/1986 | Netherlands | 414/408 |
| 2092094 | 8/1982 | United Kingdom | 414/408 |
| 2165814 | 4/1986 | United Kingdom | 414/406 |
| 8303242 | 9/1983 | World Int. Prop. O. | 414/409 |

*Primary Examiner*—David A. Bucci
*Assistant Examiner*—John Vanden Bosche
*Attorney, Agent, or Firm*—Stoel Rives Boley Jones & Grey

[57] ABSTRACT

A mechanism (20) for automatic dumping of standardized portable refuse containers (35) into a hopper (22) of a refuse collection vehicle (24). The mechanism includes an assembly (32) for clamping the protruding lip (33) of the container (35). The assembly (32) is then tilted over the hopper (22) by an actuator (54) that is connected to the assembly (32) via two links (40, 42). The components of the mechanism (20) are arranged to minimize the extent to which the mechanism (20) protrudes outwardly from the hopper (22).

13 Claims, 5 Drawing Sheets

CONTAINER DUMPING MECHANISM

TECHNICAL FIELD

This invention pertains to mechanisms for dumping portable refuse containers.

BACKGROUND INFORMATION

A common type of refuse collection vehicle for residential or light commercial applications includes a hopper that extends forwardly from the base of a refuse-holding compartment. Refuse is dumped from portable containers into the hopper. When the hopper is filled, a mechanical ram is actuated to push the refuse out of the hopper and into the holding compartment.

In the past, refuse containers were manually lifted over the hopper to dump the container contents. More recently, container dumping mechanisms have been developed for automatically dumping the refuse containers. Development of these dumping mechanisms has been generally concurrent with the development of standardized refuse containers that include structural components that can be engaged by the automatic dumping mechanisms. In this regard, such standardized refuse containers usually carry a pair of apart-spaced horizontal cross bars. The cross bars may be discrete components that are attached to the container, or they may be integrally formed with the remainder of the container. The cross bars may or may not be recessed into the container wall.

Conventional container dumping mechanisms have been designed to include movable latches for engaging the container cross bars. The latches are moved by linkages that are also employed to lift the latched container over the hopper and to tilt the container to dump its contents.

The linkage assemblies of the dumping mechanisms that are designed to engage the container cross bars are very complex, which complexity renders these mechanisms costly to manufacture. Further, prior dumping mechanisms are bulky and, consequently, they protrude outwardly from the hopper to oftentimes interfere with the safe operation of the refuse collection vehicle.

SUMMARY OF THE INVENTION

This invention is directed to a container dumping mechanism that is less complex than those heretofore available and that is designed to minimize the extent to which the mechanism protrudes outwardly from the hopper.

The container dumping mechanism of the present invention clamps the top lip of a portable refuse container. The mechanism is configured so that the components used for clamping the container lip are suspended near the side of a hopper. The components that are used to dump the container are carried above the hopper.

The container dumping mechanism of the present invention particularly comprises a rigid frame that includes a top cross member. A clamp element is mounted for sliding movement within the frame. The clamp element is moved by a clamp actuator to engage the container lip and to clamp the lip against the top cross member.

A support arm is connected to the refuse collection vehicle. The frame is connected via two links to the support arm in a manner such that the frame is suspended along the side of the hopper. A lift actuator is mounted to the support arm and is actuated to move the links to lift the frame (and clamped container) over the hopper.

The clamp element includes a plurality of resilient teeth that fit within the space beneath the container lip. Further, the top cross member of the frame carries a resilient clamp bar. The teeth and clamp bar combine to securely clamp the container lip therebetween without damaging the container.

As another aspect of this invention, the clamp actuator and the lift actuator are controlled by a hydraulic control system that controls the operational sequence of those actuators in a manner such that the container will be securely clamped to the frame before and during the time the lift actuator moves the frame over the hopper.

DETAILED DESCRIPTION OF THE PREFERRED EMBODIMENT

Figure 1:
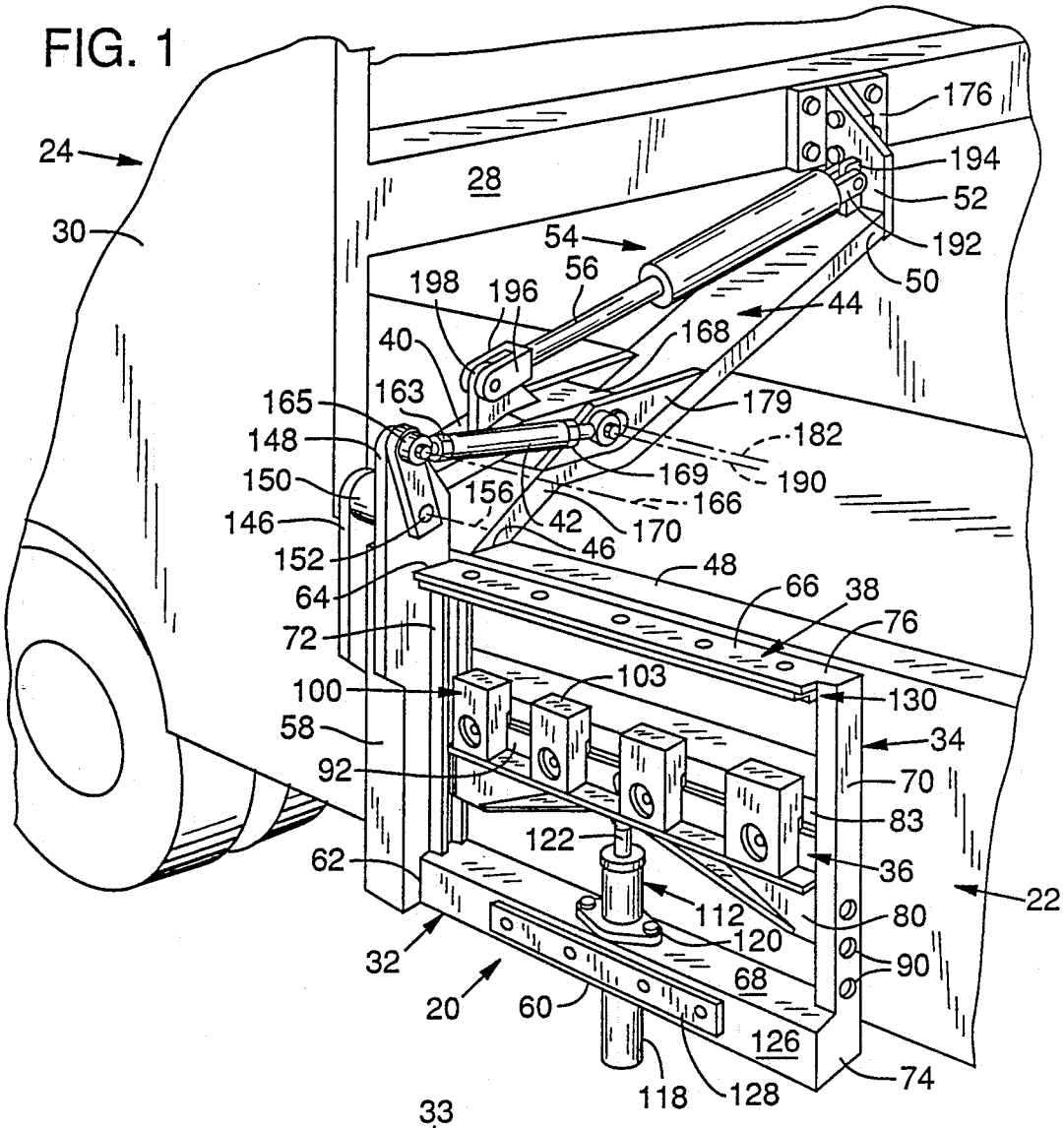
FIG. 1 is a perspective view of the container dumping mechanism of the present invention.

With reference to FIG. 1, the container dumping mechanism 20 of the present invention is shown mounted adjacent to the hopper 22 of a refuse collection vehicle 24 near the forwardmost wall 28 of the refuse-holding compartment 30 of the vehicle 24. Refuse dumped into the hopper 22 is pushed by a ram (not shown) into the holding compartment 30.

The container dumping mechanism 20 includes a container clamping assembly 32. The clamping assembly 32 comprises a rigid frame 34 that has a clamp element 36 mounted for sliding movement within frame 34. The clamp element 36 is movable into a position adjacent to the top cross member 38 of the frame 34 to clamp the lip 33 of a refuse container 35 (FIG. 4) against the top cross member 38.

The clamping assembly 32 is connected via a drive link 40 and a drag link 42 to an elongated support arm 44. One end 46 of the support arm 44 rests upon the edge 48 of the hopper 22. The inner end 50 of the support arm 44 is fastened to the forwardmost wall 28 of the holding compartment 30 by brackets 52, 176.

Figure 7:
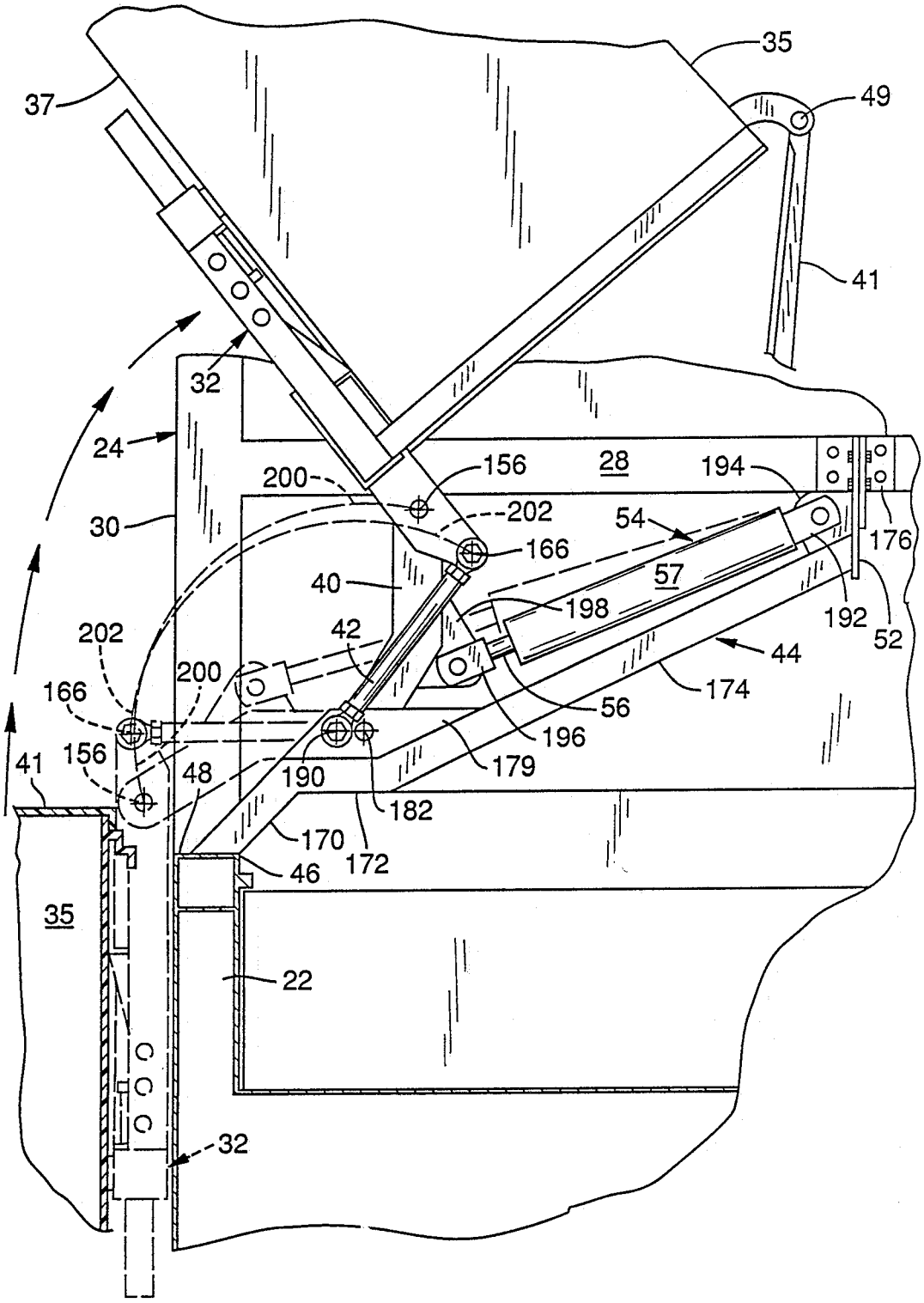
FIG. 7 is a side elevation view of the container dumping mechanism.

A hydraulic piston and cylinder-type lift actuator 54 is connected between the inner end 50 of the support arm 44 and the drive link 40. Whenever the actuator piston rod 56 is retracted, the clamping assembly 32, including the clamped container 35, is moved over the hopper 22 and tilted to dump the container contents (FIG. 7).

Turning to the particulars of the preferred embodiment, and with reference to FIGS. 1–7, the frame 34 of the clamping assembly 32 is attached to a rigid post 58. The frame 34 includes a rigid elongated bottom cross member 60 that is fastened at its rearward end 62 to the bottom of the post 58. The bottom cross member 60 extends forwardly from the post 58. Preferably, the post 58 and bottom cross member 60 are structural tubes having square cross sections.

The frame top cross member 38 is fastened at its rearward end 64 to the top of the post 58 and extends forwardly therefrom. The top cross member 38 is L-shaped in cross section, having one leg 66 disposed in a plane that is parallel to the plane of the flat upper surface 68 of the bottom cross member 60.

A rigid rear channel 72 is fastened to the post 58 to extend between the rearward end 62 of the bottom cross member 60 and the rearward end 64 of the top cross member 38. A rigid front channel 70 is fastened between the forward end 74 of the bottom cross member 60 and the forward end 76 of the top cross member 38. The front and rear channels 70, 72 are arranged so that their open sides face each other.

Figure 4:
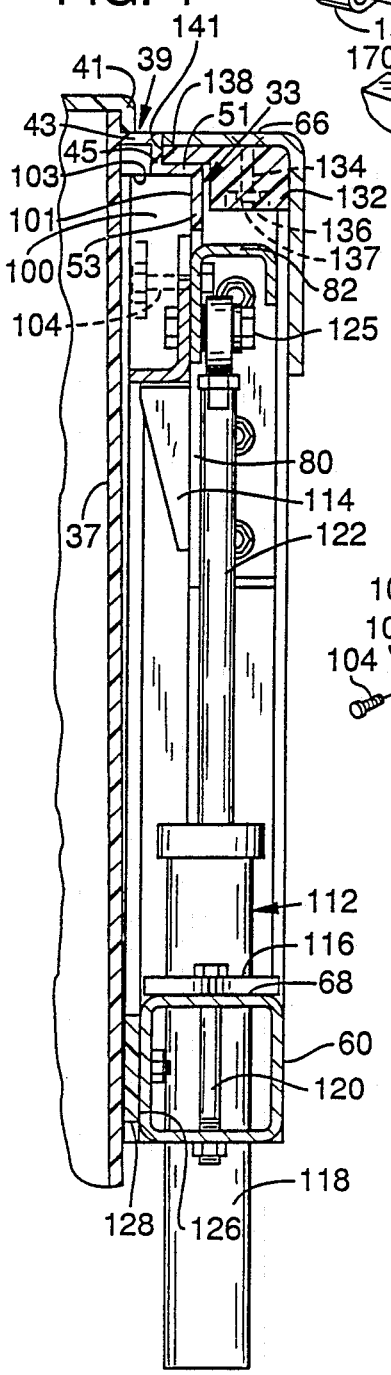
FIG. 4 is a sectional view of the container clamping assembly showing the clamp element extended to clamp a container lip.
Figure 5:
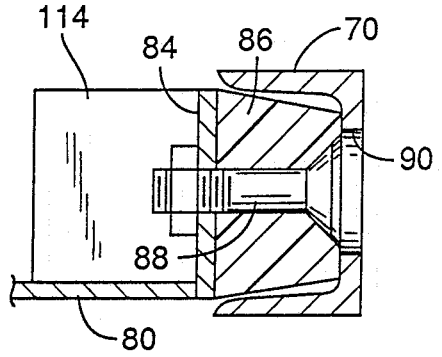
FIG. 5 is a sectional view taken along line 5—5 of FIG. 3.
Figure 3:
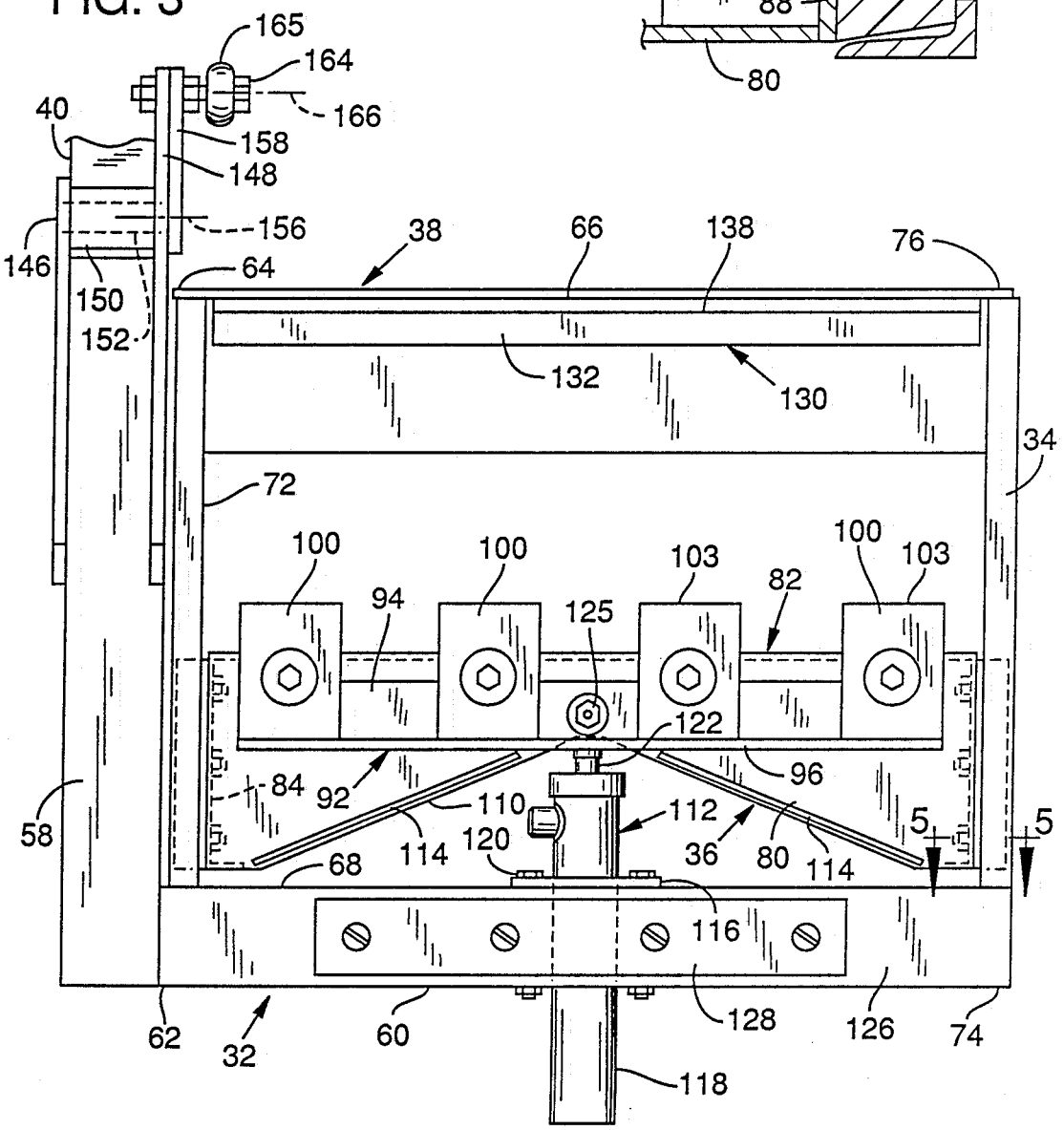
FIG. 3 is a front elevation view of the container clamping assembly of the container dumping mechanism.

The clamp element 36 slides along the front and rear channels 70, 72. In this regard, the clamp element 36 includes a rigid clamp plate 80, the top 82 of which is formed into a downward-opening channel (FIG. 4). The opposing sides of the clamp plate 80 carry flat rectangular mounting plates 84. Slider blocks 86 (FIGS. 2, 5) are mounted to the outer surfaces of the mounting plates 84 via threaded fasteners 88, the heads of which fasteners are countersunk within the slider blocks 86. The slider blocks 86 are formed of low-friction material such as ultra high molecular weight (UHMW) polyethylene. The slider blocks 86 fit within the front and rear channels 70, 72 and facilitate the sliding movement of the clamp element 36 within the frame 34.

Access holes 90 are provided in the front channel 70 so that the fasteners 88 that are used to attach the associated slider block 86 to the clamp plate 80 can be inserted or removed through the holes 90. Accordingly, the clamp element 36 can be removed from its position between the channels 70, 72 without the need for disassembling the frame 34 of the clamping assembly 32.

A rigid comb member 92 is fastened to one side of the clamp plate 80 near the top surface 83 of the clamp plate 80. The comb member 92 is L-shaped in cross section, having a vertical leg 94 extending slightly beyond the top surface 83, and a horizontal leg 96 protruding outwardly from the clamp plate 80.

The uppermost edge of the vertical leg 94 of the comb member 92 is notched to define four rectangular projections 98. A generally block-shaped tooth 100 is attached to the comb member 92 at each projection 98. Preferably, the teeth 100 are formed of UHMW polyethylene. The inner face 101 of each tooth 100 carries a recess 102 that is configured so that the upper portion of the tooth 100 extends over the projection 98. The lower portion of the tooth 100 abuts the vertical leg 94 of the comb member 92. Each tooth 100 extends upwardly from the horizontal leg 96 of the comb member 92 to terminate in a flat top surface 103.

The teeth 100 are held in place with fasteners 104 and washers 106 that are threaded through the comb member 92 and the clamp plate 80. The outer surface of each tooth 100 has a recess 108 formed therein to accommodate the washer 106 and the fastener 104 head.

A downward-opening V-shaped notch 110 is formed in the lower portion of the clamp plate 80. The notch 110 provides clearance between the clamp plate 80 and bottom cross member 60 for the upper end of a piston and cylinder-type clamp actuator 112 that is mounted to the bottom cross member 60 and is described more fully below. The clamp plate 80 is reinforced with gussets 114 along its lower edge.

The clamp actuator 112 is preferably a dual-action fluid-driven type. A flange plate 116 is fastened to the clamp actuator 112 between the ends of the cylinder 118. The clamp actuator 112 is mounted to the bottom cross member 60 with the flange plate 116 resting upon the upper surface 68 thereof. The actuator cylinder 118 extends through correspondingly-shaped holes in the bottom cross member 60. The flange plate 116 (hence, the clamp actuator 112) is held in place by threaded fasteners 120.

The end of the clamp actuator piston rod 122 carries a spherical rod end 124 and is connected via a threaded fastener 125 to the clamp plate 80 near the apex of the V-shaped notch 110.

The outer surface 126 of the bottom cross member 60 carries a resilient bumper bar 128 that is preferably formed of UHMW polyethylene. As will be clear upon reading this description, the bumper bar 128 bears against the container wall 37 whenever the clamped container 35 is tilted by the dumping mechanism 20.

A resilient clamp bar 130 is fastened to the underside of the horizontally disposed leg 66 of the top cross member 38. The clamp bar 130, which is formed of UHMW polyethylene, includes a base 132 that is shaped to fit within the interior corner of the top cross member 38. Threaded fasteners 134 are countersunk at apart-spaced locations through the horizontal leg 66 of the top cross member 38 to extend partly through the base 132 of the clamp bar 130. The fasteners 134 terminate within recesses 136 formed in the underside of the clamp bar base 132. Nuts 137 are threaded over the ends of the fasteners 134.

An integrally formed extension piece 138 of the clamp bar 130 extends outwardly from the base 132 beneath the outermost portion of the top cross member leg 66. The extension piece 138 has a reduced thickness (measured vertically in FIG. 4) relative to the base 132, thereby defining a right-angle indentation extending along the length of the clamp bar 130. The outermost surface of the extension piece 138 and of the horizontal leg 66 define a planar contact surface 141, the significance of which is described below.

The clamp bar 130 is configured and arranged so that whenever the clamp element 36 is moved to a position (hereafter referred to as the clamp position) wherein the teeth 100 are adjacent to the clamp bar 130, there is formed between the clamp bar 130 and teeth 100 a gap that substantially corresponds in cross sectional configuration to the cross sectional shape of the downward-turned lip 33 formed in the refuse container 35.

Figure 6:
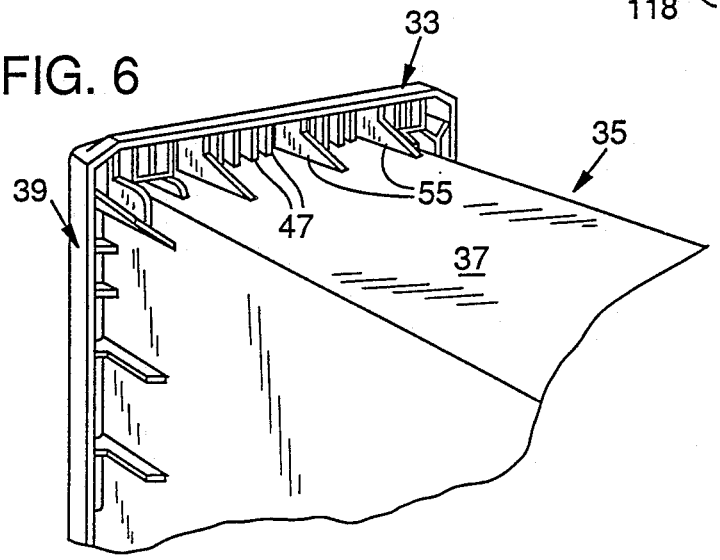
FIG. 6 is a perspective view of a portable refuse container showing the underside of the protruding lip.

More particularly, with reference to FIGS. 4 and 6, a conventional portable refuse container 35 includes an outwardly projecting rim 39 extending around the top of the container 35 for increasing the rigidity of the container and for providing a seating surface for the container lid 41. The rim 39 is L-shaped in cross section, having a horizontal leg 43 extending outwardly from the container wall 37 and a vertical leg 45 extending downwardly from the outer edge of the horizontal leg 43. The underside of the container rim 39 is reinforced with a plurality of apart-spaced flat webs 47 that extend in planes substantially perpendicular to the plane of the container wall 37.

The container lip 33 is formed along the side of the container 35 that is opposite the side of the container that carries the lid hinges 49 (FIG. 7). The container lip 33 is L-shaped in cross section, having a horizontal leg 51 that is contiguous with and extends outwardly from the lower end of the vertical leg 45 of the container rim 39, and a vertical leg 53 that extends downwardly from the outermost end of the horizontal leg 51. Three flat apart-spaced stiffeners 55 extend in planes perpendicular to the container wall 37 within the space beneath the container lip 33.

In order to clamp the container lip 33, the clamp actuator 112 is operated to lower the clamp element 36. The container 35 is wheeled or slid against the clamp element 36 so that the lip 33 extends over the teeth 100 of the clamp element. The clamp actuator 112 is then operated to raise the clamp element 36 so that the top surfaces 103 of the teeth 100 fit under the container lip 33 and bear upon the underside of the horizontal leg 51 of the lip 33 and upon the underside of the rim webs 47 (FIG. 4). The container 35 is thus lifted into the clamped position wherein the horizontal leg 51 of the lip 33 is clamped between the top surface 103 of the teeth 100 and the extension piece 138 of the clamp bar 130. The stiffeners 55 are disposed within the spaces between the teeth 100. The vertical leg 53 of the lip 33 extends along the inner face 101 of each tooth. The vertical leg 45 of the container rim 39 abuts the contact surface 141 that is formed by the leg 66 of the top cross member 38 and the clamp bar extension piece 138.

It can be appreciated that while in the clamped position, the top portion of the container 35 is unable to move relative to the clamp element 36. Further, the resilience of the polyethylene teeth 100 and clamp bar 130 permits tight clamping of the lip 33 without damage to the container 35. It can also be appreciated that the particular shape of the teeth 100 and clamp bar 130 can be modified to effectively clamp refuse containers that have lip configurations other than that just described.

Figure 2:
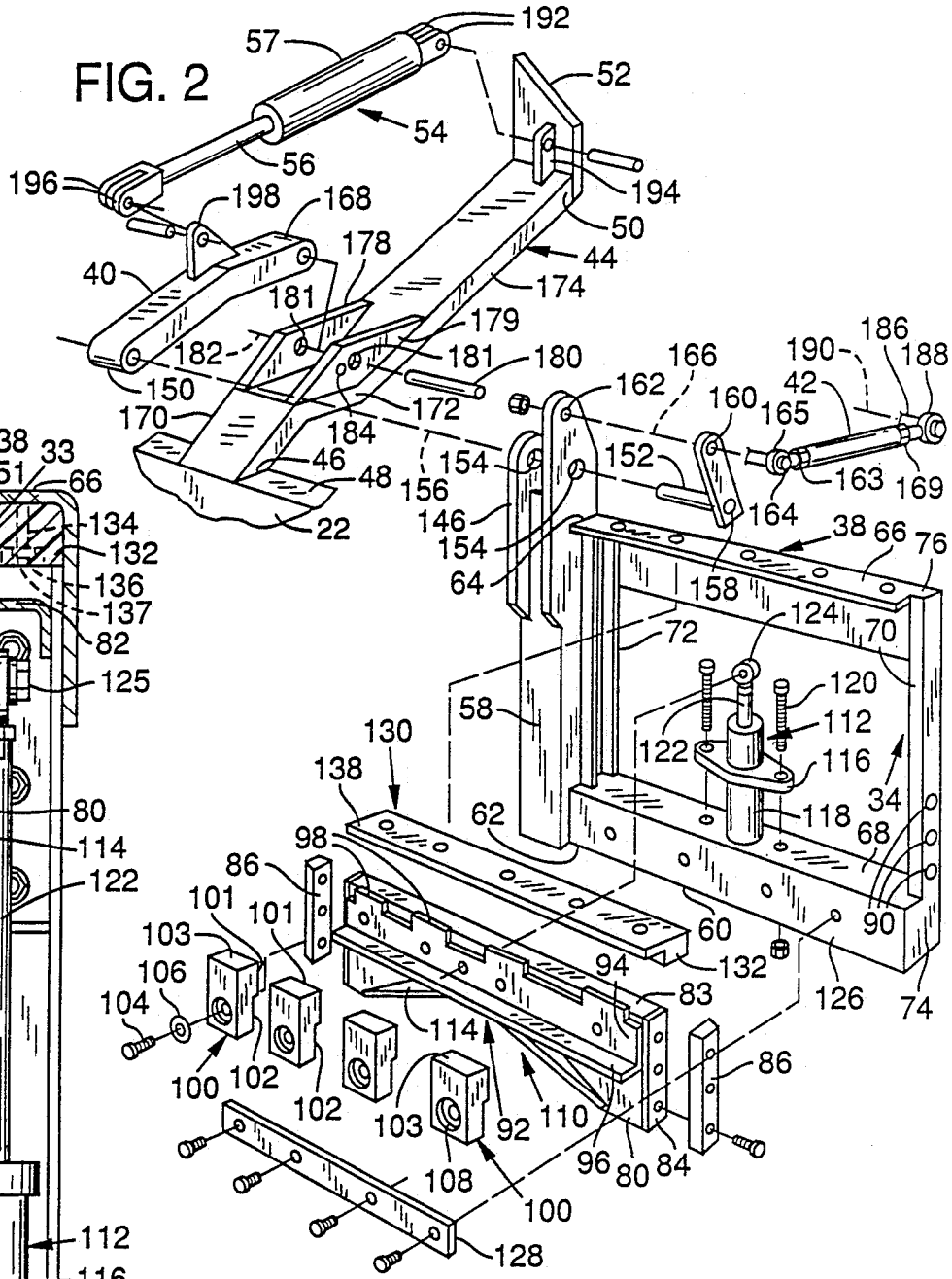
FIG. 2 is an exploded view of the container dumping mechanism.

Turning now to the components of the mechanism 20 that are employed for lifting the container over the hopper, the clamping assembly 32 is connected to the support arm 44 via pivotal connections with the drive link 40 and drag link 42 mentioned earlier. Specifically, a rearward tongue 146 and a relatively longer forward tongue 148 extend upwardly from the top of the post 58 (FIG. 2). The tongues 146, 148 are spaced apart from one another and the outer end 150 of the rigid drive link 40 fits between them. That end 150 of the drive link 40 is fitted with bearings (not shown) for pivotal connection between the tongues 146, 148. A pivot pin 152 extends through aligned apertures 154 in the tongues 146, 148 to secure the outer end 150 of the drive link 40 between the tongues. The pivot pin 152 defines a first pivot axis 156.

One end of the pivot pin 152 has a flat spacer bar 158 fastened to it. The spacer bar 158 has an aperture 160 formed therein, which aperture 160 is aligned with another aperture 162 formed at the upper end of the forward tongue 148.

The outer end 163 of the drag link 42 carries a spherical rod end 165 and is pivotably fastened to the forward tongue 148 by a threaded fastener 164 that extends through the apertures 160, 162 in the spacer bar 158 and in the tongue 148. The outer end of the drag link 42 pivots about the fastener 164. The central axis of the fastener 164 defines a second pivot axis 166.

The support arm 44, to which the respective inner ends 168, 169 of the drive link 40 and drag link 42 are connected, comprises a beam having an outer portion 170, a middle portion 172 and an inner portion 174 (FIG. 2). One end 46 of the outer portion 170 of the support arm 44 rests upon the edge 48 of the hopper 22. The arm extends inwardly (i.e., toward the center of the hopper) from the hopper edge 48 at an inclination of approximately 45° from horizontal.

The relatively steep incline of the outer portion 170 of the support arm 44 provides sufficient clearance over the hopper 22 for the remaining portions 172, 174 of the support arm. The outer portion 170 of the support arm 44 extends over approximately the outermost 3% to 5% of the hopper width (measured horizontally in FIG. 7).

The middle portion 172 of the support arm 44 extends horizontally from the location it joins the outer portion 170. The middle portion 172 extends over approximately 8% to 10% of the hopper width.

From the innermost end of the middle portion 172, the inner portion 174 of the support arm extends over approximately 30% to 35% of the hopper width and is inclined upwardly at an angle of approximately 25° from horizontal.

The innermost end of the support arm 44 terminates in the flat bracket 52 that extends in a substantially vertical plane. The bracket 52 is fastened to the projecting portion of a tee bracket 176 that is mounted to the forwardmost wall 28 of the holding compartment 30 of the refuse collection vehicle 24.

Two apart-spaced flat pivot brackets 178, 179 (FIG. 2) are mounted to the upper surface of the support arm across the junction of the middle portion 172 and inner portion 174 of the support arm 44. The inner end 168 of the drive link is pivotably secured between the pivot brackets 178, 179 by a pivot pin 180 that passes through the drive link 40 and through aligned apertures 181 in the brackets 178, 179. The pivot pin 180 defines a third pivot axis 182.

The drive link 40 is shaped so that when the lift actuator piston rod 56 is fully extended (as shown in broken line in FIG. 7) the link 40 extends substantially horizontally outwardly from the third pivot axis 182, and bends downwardly approximately 30° from horizontal at its midpoint.

The forwardmost pivot bracket 179 includes a second aperture 184 that receives a threaded fastener 186. That fastener 186 passes through a spherical rod end 188 that is fastened to the inner end 169 of the drag link 42. Accordingly, the drag link 42 is connected at its inner end to pivot about a fourth pivot axis 190 defined by the central axis of the fastener 186.

As noted earlier, the lift actuator 54 is interconnected between the inner end 50 of the support arm 44 and the drive link 40. Specifically, the cylinder 57 of the actuator 54 carries a pair of projecting tongues 192 that have pinned between them a flat pivot bracket 194 that is fastened to the bracket 52 that is mounted to the inner end 50 of the support arm.

The exposed end of the lift actuator piston rod 56 also carries a projecting pair of tongues 196 that have pinned between them a drive link pivot bracket 198. The drive link pivot bracket 198 is fixed to the top of the drive link 40 and extends outwardly from the drive link so that the location of the pivotal connection of the actuator piston rod 56 is such that retraction and extension of the rod 56 will result in non-binding rotation of the drive link 40 about the third pivot axis 182 as explained more fully below.

Turning now to the tilting operation performed by the container dumping mechanism 20 of the present invention, the broken lines in FIG. 7 show the container dumping mechanism in a position with the container clamping assembly 32 suspended alongside the hopper 22 with a container 35 clamped thereto as described in detail above. This position of the assembly will be hereafter referred to as the load/unload position. It is noteworthy that the clamping assembly 32 protrudes outwardly from the hopper 22 by an amount corresponding to the width of the clamping assembly frame 34. Space is not required between the clamping assembly 32 and the hopper 22 for housing the links 40, 42 and actuator 54 used for tilting the container 35.

With the container 35 clamped, the lift actuator 54 is operated to retract the piston rod 56, thereby rotating the drive link 40 about the fixed third pivot axis 182. Simultaneously, the first pivot axis 156 is moved through an arc 200 from the load/unload position to the dumping position of the assembly 32, as shown in solid lines in FIG. 7.

The drag link 42 is configured and arranged in cooperation with the drive link 40 so that as the drive link 40 pivots about the fixed third pivot axis 182 the drag link 42 drags the second pivot axis 166 along another arc 202. The arc 202 intersects (in the plane of FIG. 7) the arc 200 between the load/unload position and the dumping position. Consequently, the second pivot axis 166 moves from a position above the first pivot axis 156 at the unload position, to a position substantially below the first pivot axis 156 at the dumping position. Since the first and second pivot axes 156, 166 are fixed relative to the position of the clamping assembly 32, the just-described relative movement of these axes causes the clamping assembly 32 to swing the container 35 from an upright orientation in the load/unload position to a substantially inverted orientation in the dumping position.

The length of the arc 200 between the load/unload position and the dumping position is approximately 33% of the circumference of the circle that is defined by the radius between the first pivot axis 156 and the third pivot axis 182. This relatively short arc minimizes the amount of container travel in moving from the load/unload position to the dumping position and back.

After the container 35 is emptied, the lift actuator 54 is operated to extend the piston rod 56 so that the clamping assembly reassumes the load/unload position. Afterward, the clamping actuator 112 is operated to lower the clamp element 36 thereby releasing the container lip 33.

Figure 8:
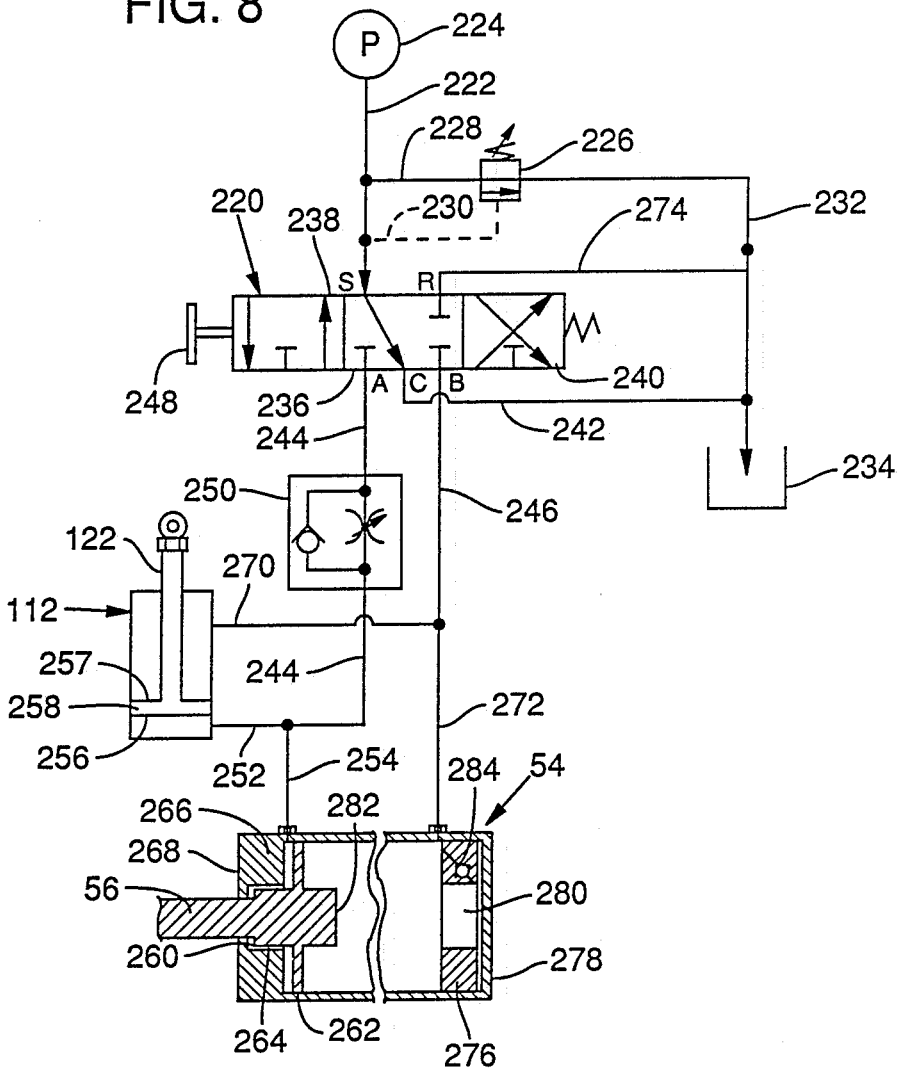
FIG. 8 is schematic diagram of the hydraulic system for operating the container dumping mechanism.

FIG. 8 depicts the schematic diagram of the preferred hydraulic circuitry employed for operating the container dumping mechanism of the present invention. The hydraulic system includes a control valve 220 that is manually operated to direct pressurized hydraulic fluid to and from the lift actuator 54 and the clamp actuator 112. Pressurized hydraulic fluid is delivered via source line 222 to the control valve 220 from a source such as a pump 224. Preferably, the hydraulic fluid is delivered under a pressure of approximately 1,800 pounds per square inch (psi) and at a rate of 5 gallons per minute.

The control valve 220 includes a built-in adjustable relief valve 226 that is connected to the source line 222 by a branch line 228. A pilot line 230 directs pressurized source fluid to the relief valve 226 to open the valve 226 whenever the source line pressure exceeds the maximum pressure selected by the operator who adjusts the relief valve 226. Once the relief valve 226 is opened, the fluid in source line 222 is delivered via lines 228, 232 to a hydraulic fluid reservoir 234.

The control valve 220 includes five ports labeled S (source) R (return) A, B and C. The control valve 220 is movable into a "neutral" position 236 represented by the central segment of the schematic drawing of the control valve 220 (FIG. 8), a "lift" position 238 represented by the left-most segment of the schematic drawing of the control valve, and a "lower" position 240 represented by the right-most segment of the control valve schematic.

The control valve 220 is spring-centered to normally assume a neutral position 236. In the neutral position, the lands and grooves of the control valve 220 are configured to direct the source fluid received in port S out through port C to a recirculate line 242 that is interconnected between port C and the reservoir 234.

Ports A and B of the control valve 220 have connected to them lines 244, 246, respectively, which lines 244, 246 deliver the fluid to and from the clamp actuator 112 and the lift actuator 54. Whenever the control valve 220 is in the neutral position, the lines 244, 246 to those actuators 112, 54 are closed at the control valve 220, thereby maintaining in lines 244, 246 whatever pressure existed in those lines just prior to the movement of the control valve 220 into the neutral position. Accordingly, movement of the control valve 220 into the neutral position at any time during the operation of the container dumping mechanism 20 will halt movement of the container 35 without permitting the container to drop.

In FIG. 8, the lift actuator 54 is depicted with the piston rod 56 fully extended so that the container clamping assembly 32 is in the load/unload position (see FIG. 1). Further, FIG. 8 shows the clamp actuator 112 with the piston rod 122 fully retracted (see FIG. 3) so that the container 35 is not clamped thereto.

To clamp the container lip 33 and to lift the clamping assembly 32 and container 35 over the hopper 22 as described earlier, the hydraulic control valve 220 is moved, via lever 248 into the "lift" position 238.

When the control valve 220 is moved into the "lift" position 238, pressurized hydraulic fluid from the source 224 is directed from port S to port A and into line 244. The fluid in line 244 passes through a flow control valve 250. Fluid flowing through the flow control valve 250 in a direction toward the actuators 54, 112 is, however, unrestricted by the flow control valve 250.

The pressurized fluid in line 244 branches into one line 252 that leads to the clamp actuator 112 and into another line 254 that leads to the lift actuator 54. In accordance with the present invention, hydraulic fluid delivered in parallel through lines 252, 254 first causes the clamp actuator 112 to raise the clamp element 36 to clamp the container 35 before the lift actuator 54 lifts the clamp assembly 32 (and container 35) over the hopper 22 for dumping.

More particularly, the pressurized fluid delivered to the clamp actuator 112 via line 252 acts on the blind side 256 of the clamp actuator piston 258, causing extension of the piston rod 122 until the teeth 100 of the clamp element 36 tightly clamp the container lip 33 as shown in FIG. 4. In the preferred embodiment, the clamp actuator 112 will generate sufficient force to clamp and support a fully loaded container 35 as the hydraulic fluid delivered to the actuator 112 via line 252 reaches a pressure of approximately 100 psi (the "clamping pressure").

The lift actuator 54 is configured so that the rod 56 will be retracted (i.e., the clamp assembly 32 lifted) only after the pressure delivered to the actuator 54 via line 254 significantly exceeds the clamping pressure. In this regard, the rod side 260 of the lift actuator piston 262 is configured to fit within a chamber 264 that is defined by a rigid annular cushion 266 mounted to the gland 268 of the actuator 54. The chamber 264 is sized so that the side 260 of the piston rod 262 seats therein with very little clearance. Fluid in line 254 is directed between the piston 262 and cushion 266 into the chamber 264.

Whenever the rod side 260 of the piston 262 is seated within the chamber 264, substantial force is required to overcome the suction generated in the chamber as the piston 262 is forced in the direction away from the cushion 266. Accordingly, the piston 262 can be moved away from the cushion 266 only when fluid at a relatively high pressure is delivered to the chamber 264 through line 254. In the preferred embodiment, the chamber pressure must reach a pressure that is approximately 50% higher than the clamping pressure before the piston 262 of the lift actuator 54 will move. The pressure in the chamber 264 will not begin to exceed the clamping pressure until the container 35 is clamped to the clamping assembly 32 upon extension of the clamp actuator rod 122 as described above.

With the clamp actuator rod 122 fully extended, the pressure in lines 252, 254 rapidly exceeds the clamping pressure, thereby forcing the lift actuator piston 262 away from the cushion 266 to retract the rod 56, and thereby move the clamped container 35 over the hopper 22 for dumping.

As the pistons 258, 262 of the clamp and lift actuators 54, 112 move as just described, fluid is expelled from the clamp actuator 112 into a connected line 270, and from the lift actuator into a connected line 272. The lines 270, 272 join the line 246 that leads to port B in the control valve 220. When in the "lift" position 238, the control valve 220 directs the expelled fluid that arrives at port B to the return port R, from where the fluid circulates to the reservoir 234 via the line 274 that connects the reservoir with port R.

With reference to FIG. 7, it can be appreciated that, as the container is moved into the dumping position (i.e., as the lift actuator 54 reaches the end of its lift stroke), the drive link 40, to which the actuator piston rod 56 is attached, will move over the lower pivot axis 182 of the link 40, thereby changing the tension load on the piston rod 56 to a compressive load. With the change in load direction on the rod 56, there normally would occur a consequent drop in the pressure in lines 252, 254; however, the hydraulic control system of the present invention is configured to ensure that this pressure drop in lines 252, 254 is effectively countered so that the piston rod 122 of the clamp actuator 112 remains fully extended to clamp the container 35 as the lift actuator 54 reaches the end of the lift stroke.

More particularly, a cushion 276 is attached to the end plate 278 of the lift actuator 54 to define a chamber 280 into which the blind side 282 of the piston 262 will fit. The piston 262 reaches the chamber 280 just as the drive link 40 moves over its lower pivot axis 182 as described above. The movement of the piston 262 is rapidly slowed by the pressure rise in the chamber 280 as the blind side 282 of the piston enters the chamber. The slowing of the piston 262 increases the pressure on the rod side 260 of the piston and, therefore, the pressure in lines 252, 254. Consequently, the pressure acting on the blind side 256 of the clamp actuator piston 258 remains sufficiently above the clamping pressure, even at the end of the lifting stroke of the lift actuator 54.

After the contents of the container 35 fall into the hopper 22, the container is lowered by moving the control valve 220 into the "lower" position 240. When the control valve 220 is moved into the lower position 240, the pressurized fluid from the source 224 is directed from port S to port B, through line 246, from where it branches into lines 270, 272. The fluid directed into the lift actuator 54 via line 272 acts on the blind side 282 of the piston 262. Relatively low pressure is required to move the piston 262 away from the cushion 276 because the cushion includes a check valve 284 that permits fluid from the line 272 to freely flow into the chamber 280 between the end plate 278 and the piston 262. (The same valve 284 restricts flow into line 272 to provide the slowing of the piston 262 as the piston enters the chamber 280 at the end of the lift stroke as described earlier).

The rate of descent of the container 35, and the sequence under which the container is completely lowered before being unclamped, are controlled by the flow control valve 250. In this regard, the fluid expelled from the actuators 54, 112 as the container is lowered, passes through lines 252, 254 and then into line 244. Line 244 passes through the flow control valve 250 to the hydraulic control valve 220, from where the fluid is directed through port R into the reservoir 234 via line 274.

The fluid passing through the flow control valve 250 in the direction toward the hydraulic control valve 220 is restricted by an amount that creates a back pressure in the range of 50 to 150 psi in lines 252, 254. This back pressure is sufficient for generating force on the rod side 260 of the lift actuator piston 262 that resists the force of gravity acting on the clamping assembly 32 and clamped container 35. Accordingly, the container 35 is positively and slowly lowered as the fluid pressure delivered into the lift actuator 54 via line 272 just exceeds the back pressure acting on the lift actuator piston 262.

The back pressure in the fluid that is expelled through line 252 also keeps the container 35 clamped to the clamping assembly 32 until that clamping assembly is completely lowered by the lift actuator 54. In this regard, the back pressure in line 252 acts against the blind side 256 of the clamp actuator piston 258. The area of the piston blind side 256 is larger than the area of the rod side 257 of the piston 258. The source fluid delivered to the smaller-area rod side 257 of the piston via line 270 (the pressure of which fluid only slightly exceeds the back pressure in line 252) will not generate a force on the piston rod side 257 that is sufficient to overcome the force on the piston blind side 256 that results from the back pressure. In short, the container remains clamped until the lift actuator rod 56 is fully extended.

As the lift actuator rod 56 nears full extension, movement of the clamp assembly 32 is slowed as the lift actuator piston 262 reaches the above-described cushion 266. When the piston 262 is completely stopped, the pressure in line 270 quickly builds to overcome the back pressure acting on the clamp actuator piston 258, and the clamp element 36 is lowered to release the container 35.

While the preferred embodiment of the invention has been illustrated and described, it will be appreciated that various changes may be made therein without departing from the spirit and scope of the invention. For instance, the clamping assembly 32 has been shown and described as suspended over the right side (i.e., as the vehicle is viewed from the rear) of the hopper. It is contemplated, however, that the container dumping mechanism could be arranged with the container clamping assembly 32 suspended over the left side of the hopper 22. Further, the clamping assembly frame 34 (including top cross member 38, bottom cross member 60, rear channel 72 and front channel 70) could be assembled as a unit and attached to either side of the post 58 with releasable fasteners, such as bolts. Since either the rearward or forward end of the clamping assembly frame 34 could be fastened to the post 58, the same post 58 and clamping assembly 32 could be used on either the right or left side of the hopper.

Use of releasable fasteners to secure the clamping assembly frame 34 to the post 58 also permits adjustment of the height of the frame 34 relative to the hopper edge 48. To this end, either the frame 34 or the post 58 could be formed with a plurality of extra fastener holes to permit the clamping assembly frame 34 to be fastened at any one of a number of positions along the length of the post 58.

I claim:

1. A mechanism for dumping a container that has a protruding member, comprising:

a frame having a cross member;

a clamp element mounted for sliding movement within the frame, the clamp element being movable in to a position adjacent to the cross member to clamp the protruding member between the cross member and the clamp element;

lift means connected to the frame for lifting and tilting the frame from a load position to a dump position thereby dumping the clamped container, the lift means including a fluid-driven lift actuator and fluid-driven clamp actuator means for moving the clamp element toward and away from the cross member;

fluid control means for directing pressurized fluid to the clamp actuator and to the lift actuator, and for controlling movement of the clamp actuator and lift actuator so that the clamp element is moved into the position adjacent to the cross member before the frame is lifted and tilted by the lift means; and cushion means disposed within the lift actuator for creating a vacuum which resists the lifting movement of the lift actuator until the clamp element is moved into the position adjacent to the cross member.

2. The mechanism of claim 1 wherein the lift actuator is movable for returning the frame to the load position, the fluid control means including return means for keeping the clamp element adjacent to the cross member until the frame is returned to the load position.

3. A mechanism for lifting a container that has a protruding member and for tilting the container over a hopper that extends from a refuse-holding compartment of a refuse collector, the hopper having an interior region and the refuse collector having a transverse member located above and extending transversely of the interior region of the hopper, the mechanism comprising:

a rigid frame;

a clamp element mounted to the frame and actuatable for clamping the protruding member to the frame;

a support arm configured for attachment to the transverse member of the refuse collector at a point directly over or within the interior region of the hopper;

first and second links interconnected between the support arm and the frame to support the frame so that the frame is suspended near the hopper, one of the first and second links being pivotally mounted to the support arm at a pivot axis located medially of the transverse member and the frame to position the pivot axis directly over or within the interior region of the hopper; and a lift actuator operatively connected to one of the first and second links for moving the frame between a load position and a dump position, wherein the clamped container is upright whenever the frame is in the load position and wherein the frame is tilted over the hopper whenever the frame is in the dump position.

4. The mechanism of claim 3 wherein the clamp element includes a plurality of teeth that fit against one side oft he protruding member to clamp the container.

5. The mechanism of claim 4, wherein the frame includes a cross member comprising a resilient clamping bar against which the protruding member is clamped.

6. The mechanism of claim 3, wherein the frame includes a cross member and a pair of guide channels attached to the cross member to extend therefrom, and wherein the clamp element includes slider members connected thereto for guiding sliding movement of the clamp element along the channels.

7. The mechanism of claim 6, wherein the frame includes a second cross member extending between the guide channels, and the clamp actuator means is interconnected between the second cross member and the clamp element for moving the clamp element toward and away from the first-mentioned cross member.

8. The mechanism of claim 3, wherein the lift actuator is operatively connected to the frame so that the frame is freely suspended.

9. The mechanism of claim 3 wherein the frame includes a bumper attached thereto and positioned to bear against the container for supporting a portion of the container weight as the container is tilted.

10. The mechanism of claim 3, wherein the first link pivotally moves about a first pivot axis and the second link pivotally moves about a second axis, the mechanism being configured so that the first pivot axis is positioned beneath the second pivot axis whenever the frame is in the load position and so that the first pivot axis is positioned above the second pivot axis whenever the frame is in the dump position.

11. A mechanism for dumping the contents of a container that has a protruding member, comprising:

a frame having a cross member;

a clamp element mounted for sliding movement within the frame, the clamp element being movable into a position adjacent to the cross member to clamp the protruding member between the cross member and the clamp element;

a fluid-driven clamp actuator connected to the frame for moving the clamp element to clamp and release the protruding member;

a fluid-driven lift actuator for lifting and tilting the frame from a load position to a dump position and thereby dumping the contents of the clamped container;

fluid control means for directing pressurized fluid to the clamp actuator and to the lift actuator, and for controlling movement of the clamp actuator and the lift actuator so that the clamp element is moved into position to clamp the protruding member before the frame is lifted and tilted by the lift actuator; and cushion means disposed within a lift actuator for creating a vacuum which resists the lifting movement of the lift actuator until the clamp element is moved into the position adjacent to the cross member.

12. The mechanism of claim 11 wherein the lift actuator is movable for returning the frame to the load position, the fluid control means including return means for keeping the clamp element adjacent to the cross member until the frame is returned to the load position.

13. The mechanism of claim 3 in which the transverse member of the refuse collector is a wall of the refuse-holding compartment.

* * * * *